US007661580B1

(12) United States Patent
Bazan

(10) Patent No.: US 7,661,580 B1
(45) Date of Patent: Feb. 16, 2010

(54) HOT FOOD CONTAINER

(76) Inventor: Edward Bazan, 4909 Souza Dr., Las Vegas, NV (US) 89146

( * ) Notice: Subject to any disclaimer, the term of this patent is extended or adjusted under 35 U.S.C. 154(b) by 0 days.

(21) Appl. No.: 11/672,320

(22) Filed: Feb. 7, 2007

(51) Int. Cl.
*B65D 43/16* (2006.01)
*B65D 5/18* (2006.01)

(52) U.S. Cl. ..... 229/149; 229/114; 229/150; 229/154; 229/193; 229/404

(58) Field of Classification Search ..... 229/149, 229/193, 404, 114, 124, 126, 141, 150, 154
See application file for complete search history.

(56) References Cited

U.S. PATENT DOCUMENTS

| | | | | | |
|---|---|---|---|---|---|
| 1,067,948 | A | * | 7/1913 | Streit | 229/149 |
| 1,941,514 | A | * | 1/1934 | Sutherland | 229/114 |
| 2,338,900 | A | * | 1/1944 | Buttery | 229/125.08 |
| 2,900,122 | A | * | 8/1959 | Steiner | 229/149 |
| 2,958,453 | A | * | 11/1960 | Collins | 229/149 |
| 3,107,039 | A | * | 10/1963 | Painter | 229/104 |
| 3,352,474 | A | * | 11/1967 | Racer | 229/149 |
| 3,942,712 | A | * | 3/1976 | Bundy et al. | 229/225 |
| 4,266,713 | A | * | 5/1981 | Maroszek | 229/146 |
| 4,714,190 | A | * | 12/1987 | Morrocco | 229/404 |
| 4,915,235 | A | | 4/1990 | Roosa | |
| 5,048,749 | A | | 9/1991 | Wischusen, III | |
| 5,226,588 | A | * | 7/1993 | Schramm et al. | 229/149 |
| 5,346,121 | A | | 9/1994 | Beales | |
| D355,598 | S | | 2/1995 | Aronhalt | |
| 5,388,758 | A | * | 2/1995 | Scovell | 229/114 |
| 5,553,772 | A | * | 9/1996 | Jensen | 229/148 |
| 5,924,626 | A | * | 7/1999 | Whitnell | 229/128 |
| D431,775 | S | | 10/2000 | Plattner et al. | |
| 6,182,890 | B1 | | 2/2001 | Sattler et al. | |
| 6,349,875 | B1 | | 2/2002 | Whitnell | |
| D454,065 | S | | 3/2002 | Bryan et al. | |
| 6,419,153 | B1 | | 7/2002 | Malta | |
| 6,758,390 | B2 | | 7/2004 | Sarson et al. | |
| D495,209 | S | | 8/2004 | Tranfaglia et al. | |
| 6,955,289 | B2 | | 10/2005 | Green | |

* cited by examiner

*Primary Examiner*—Gary E Elkins
(74) *Attorney, Agent, or Firm*—Greenberg Traurig

(57) ABSTRACT

Described is a food container made from a single piece of material. The food container includes a front and rear panel joined by opposite sides and a bottom. The rear panel includes a flap cover with a pair of locking members and the front panel includes a flap and a pair of cut-outs on opposite sides thereof wherein the cut-outs are configured to secure the locking members so that the flap is positioned beneath the flap cover when the container is closed. The disclosed container allows for the quick and efficient collection of food product without the food product being touched by human hands. The container, having closure means, acts as a measuring device such that the size of portions is consistent. The closure means also maintains the temperature of the food product, allows for later storage of food product and prevents food product from unintentionally spilling from the container.

13 Claims, 2 Drawing Sheets

HOT FOOD CONTAINER

FIELD OF THE INVENTION

The embodiments of the present invention relate to a new easy-to-use container for food, primarily heated fast food.

BACKGROUND

Fast food outlets proliferate every street corner in the U.S. While fast food restaurants are taking steps to improve the quality and healthiness of their products, they have failed to improve the delivery of such products. That is, hot foods (e.g., French fries, chicken tenders, etc.) are routinely provided to customers in open type containers which allow the food's heat to escape and fail to provide customers or the fast food outlet with consistently sized portions. Some fast food outlets have started to serve food (e.g., chicken strips) in closed containers having hinged lids. However, such containers are considerably more expensive than the open type containers and are difficult for employees to close and customers to open. In addition, many of the current containers require or encourage employees to contact the food. Such contact can be unhealthy for, and unsightly to, customers.

Typical fast food containers are formed of paper-based products because of their low cost and mass availability. The benefits of such paper-based products are still attractive, but a new, simple paper-based container design is in order. A new design should overcome the shortcomings of the prior art fast food containers while remaining inexpensive.

SUMMARY

Accordingly, one embodiment of the present invention is a container made from a single piece of material comprising: a front and rear panel joined by opposite sides and a bottom; said rear panel including a flap cover with a pair of outwardly, oppositely directed locking members; and said front panel including a flap and a pair of cut-outs on opposite sides thereof wherein said cut-outs are configured to secure said locking members such that said flap is positioned beneath said flap cover when the container is closed.

A method of using one embodiment of the container of the present invention, wherein the container has an open end, defined by a front panel, rear panel, two sides and bottom, comprises: with one hand holding the container, applying pressure to sides thereof and simultaneously scooping a desired food product into the open end; with one or more fingers or a thumb on the same hand, folding downward a flap extending from an upper portion of said front panel over said food product; and folding down a flap cover extending from an upper portion of the rear panel such that a pair of locking members on said flap cover each engage a cut-out on said front panel, one of said cut-outs on each side of the flap on the upper portion of said front panel, wherein the flap cover is positioned over the flap.

A pattern of a food container of the present invention depicted on a single piece of material comprises: an outlined front and rear panel joined by an outlined bottom, said outlined front and rear panels including outer portions foldable into container sides; an outlined flap cover extending from said outlined front panel, said outlined flap cover including a pair of outlined, outwardly, oppositely directed locking members; and an outlined flap and a pair of outlined cut-outs on opposite sides thereof wherein said outlined cut-outs are configured to secure said outlined locking members of a container constructed from the pattern such that said outlined flap is positioned beneath said outlined flap cover when the constructed container is closed.

The container of the present invention allows a fast food restaurant employee to quickly and efficiently collect a food product without having to touch the food product. In addition, the container, having closure means, acts as a measuring device such that the size of portions is consistent. Moreover, the closure means maintains the temperature of the food product, allows for later food product storage and prevents food product from unintentionally spilling from the container into an order bag or onto a uncleanly food tray.

Other variations, embodiments and features of the present invention will become evident from the following detailed description, drawings and claims.

DETAILED DESCRIPTION

It will be appreciated by those of ordinary skill in the art that the invention can be embodied in other specific forms without departing from the spirit or essential character thereof. The presently disclosed embodiments are therefore considered in all respects to be illustrative and not restrictive. While the container according to the embodiments of the present invention can be used for any food products, for the sake of brevity, fast food products are used herein to describe the container and its method of use.

Figure 1:
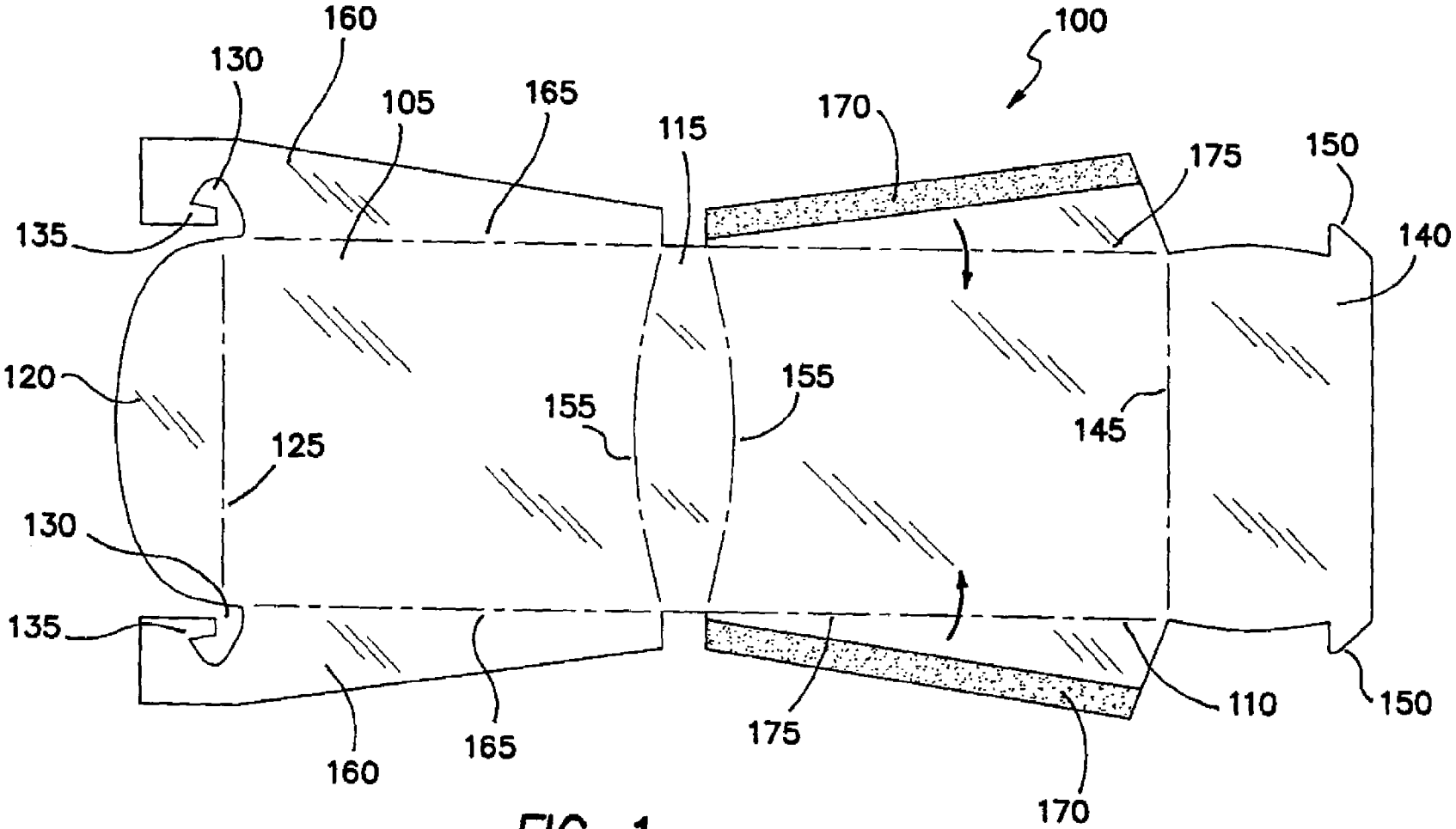
FIG. 1 illustrates a pattern of one container embodiment of the present invention.

Initial reference is made to FIG. 1 illustrating a pattern of one embodiment of the present invention generally denoted by reference numeral 100. As shown in FIG. 1, the pattern 100 provides for a container 200 to be constructed from a single piece of paper-based material like thin cardboard or other resilient paper-based product. It is also conceivable that the container 200 can be constructed of other materials, including foam or plastic.

The pattern 100 comprises a front panel 105 and rear panel 110 connected by a bottom member 115. The front panel 105 includes a flap 120 extending from a top portion thereof. Ideally, although not mandatory, during manufacturing, a pre-fold 125 is formed between the flap 120 and the front panel 105. As described in more detail below, the pre-fold 125 permits the flap 120 to be folded over food product during use of the container 200. The flap 120 acts as a level thereby determining consistent food product portions. Cut-outs 130, formed on opposite sides of the flap 120, each define a lip 135 for securing locking members 150 to close the container 200. The rear panel 110 includes a flap cover 140 extending from a top portion thereof. Ideally, although not mandatory, during manufacturing, a pre-fold 145 is formed between the flap cover 140 and the rear panel 110. Locking members 150 extend outwardly from opposite sides of the flap cover 140.

As described in more detail below, the pre-fold 145 permits the flap cover 140 to be folded over the flap 120 during use of the container 200.

From the pattern 100, a container 200 is formed by folding front panel 105 and rear panel 110 toward one another about the bottom 115, namely pre-folds 155. In one embodiment, the bottom 115 is flat allowing the container 200 to stand when constructed. The container 200 permits leftover food product to be stored for later dining. Then, sides 160 of the front panel 105 are folded inward along lines 165 which may or may not be pre-folds. Folding sides 160 causes the cut-outs 130 and lips 135 to change orientation, becoming generally perpendicular to the front panel 105 for later engagement with the locking members 150. Sides 170 of the rear panel 110 are then folded along lines 175, which may or may not be pre-folds, such that inner surfaces of the sides 170 contact outer surfaces of the sides 160 and are attached thereto using glue or other adhesive. The process of constructing the container 200 from the pattern 100 is accomplished via automated machinery as is known in the container fabricating industry. Consequently, applicant does not disclose the specifics of the automation process because they are well-known to those skilled in the art.

Figure 2:
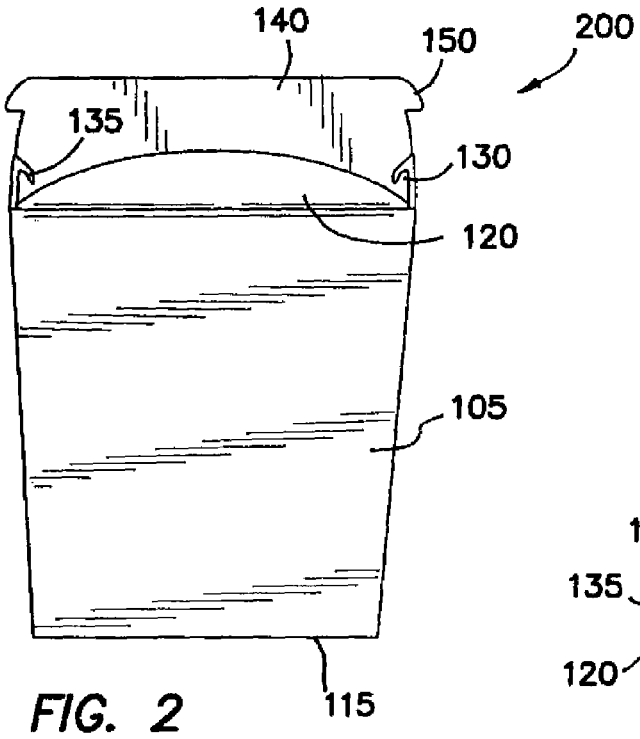
FIG. 2 illustrates a front view of a constructed container (in an open position) according to the pattern illustrated in FIG. 1.
Figure 3:
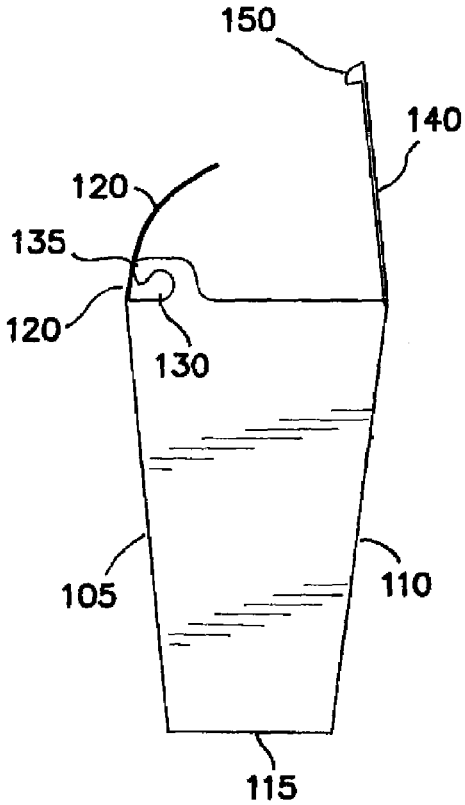
FIG. 3 illustrates a side view of a constructed container (in an open position) according to the pattern illustrated in FIG. 1.
Figure 4:
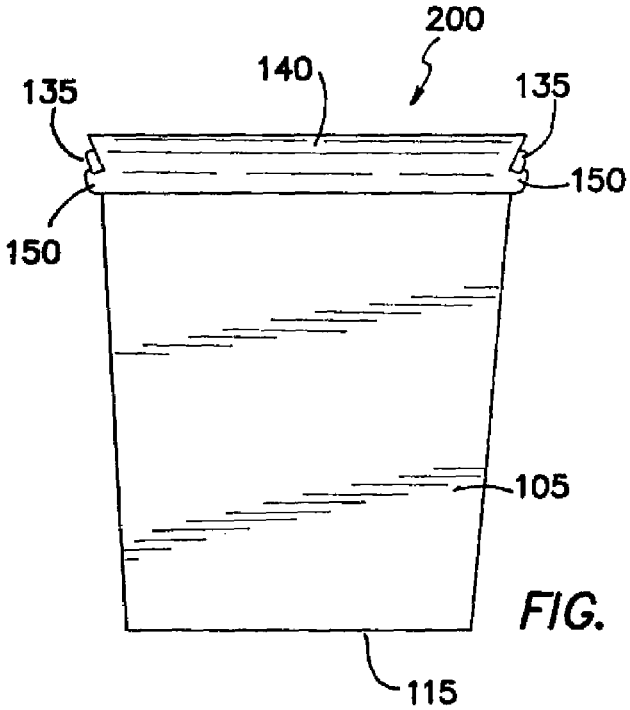
FIG. 4 illustrates a front view of a constructed container (in a closed position) according to the pattern illustrated in FIG. 1.

FIGS. 2-4 show a constructed container 200 in open and closed positions. In the open position shown in FIGS. 2 and 3, the flap 120 and flap cover 140 extend upward until time of use. Like other food containers, a plurality of containers 200 may be stored by stacking them within one another to form a sleeve of containers 200. One method of using the container 200 comprises: an individual using one hand to hold the container and apply pressure to sides thereof to expand an open end thereof. Simultaneously, the individual scoops up food product, such as French fries, fried zucchini, onion rings, chicken nuggets or tater tots, into the container 200. The individual may then vibrate or lightly shake the container 200 to settle the contents making sure that the container is full but not too full or not full enough. Once the container 200 has been filled with food product, the individual may utilize one or more fingers or a thumb on the same hand used to scoop the food product to fold downward the flap 120. In this manner, the flap 120 prevents the individual from touching the food product thereby preventing germ transfer and injuries related to burns. The flap 120 provides sturdiness to the container 200 and access to the cut-outs 130. The individual may then fold down the flap cover 140 such that the pair of locking members 150 on said flap cover 140 each engage a cut-out 130 and lip 135 such that the flap cover 140 is secured in place. A width, from the front panel 105 to the rear panel 110, and the height of the flap cover 140 in combination ideally cause a slight amount of tension when the locking members 150 engage the cut-outs 130. The tension caused by the flap cover 140 pulling away from the cut-outs 130 in a direction of the rear panel 110 prevents the locking members 150 from disengaging thereby maintaining the engagement between the locking members 150 and cut-outs 130 and lips 135 until the container 200 is intentionally opened. The flap cover 140 also maintains the flap 120 in its position under the flap cover 140. FIG. 4 shows the container 200 in a closed position.

Container 200 of the present invention allows an individual to quickly and efficiently collect a food product without having to touch the food product. In addition, by being required to close over the food product, the flap 120 and flap cover 140 act as a measuring device such that the size of portions is consistent. Moreover, the flap 120 and flap cover 140 maintain the temperature of the food product, allow for later food product storage and prevent food product from unintentionally spilling from the container 200 into a take out order bag or onto a uncleanly food tray at the restaurant selling the food product.

As the container 200 is closed upon delivery to a customer, different food containers based on the embodiments disclosed herein can be pre-labeled with the appropriate contents. The front panel 105, and other locations, of the container 200 may also be used to depict the logo of a company packaging a food product therein.

While the embodiments of the present invention are ideal for fast food, they can be used in other areas of the food industry.

Although the invention has been described in detail with reference to several embodiments, additional variations and modifications exist within the scope and spirit of the invention as described and defined in the following claims.

I claim:

1. A container made from a single piece of material comprising:

a front and rear panel joined by opposite sides and a bottom;

said rear panel including a flap cover with a pair of outwardly, oppositely directed locking members;

a front panel flap;

a pair of side members extending from said front panel, each side member having a cut-out defining a hook member wherein each of said hook members extend above, and substantially perpendicular to, a top of said front panel and is configured to secure one of said locking members such that said front panel flap is positioned beneath said flap cover so that said front panel flap blocks a portion of an open end of said container when the container is closed; and said hook members positioned rearwardly of said front panel with an upper free portion of each hook member extending toward the front of the container.

2. The container of claim 1 wherein the bottom is flat.

3. The container of claim 1 wherein the material is paper-based, foam or plastic.

4. The container of claim 1 further comprising a pre-fold between the front panel flap and the front panel.

5. The container of claim 1 further comprising a pre-fold between the flap cover and the rear panel.

6. A method of using the container of claim 1 comprising:

with one hand holding the container, applying pressure to the sides thereof and simultaneously scooping a desired food product into the open end;

with one or more fingers or a thumb on the same hand, folding downward the flap extending from an upper portion of said front panel over said food product; and folding down the flap cover extending from an upper portion of the rear panel such that the pair of locking members on said flap cover each engage a different one of the hook members on said side members such that the flap cover is positioned over the flap to close said container opening.

7. A container made from a single piece of material comprising:

a front and rear panel joined by opposite sides and a bottom;

a flap cover extending from the rear panel, said flap cover including outwardly, oppositely directed locking members;

a flap;

a pair of side members extending from said front panel, each side member having a cut-out defining a hook member wherein each of said hook members extends above, and substantially perpendicular to, a top of said front panel and is configured to secure said locking members such that said flap is folded and positioned beneath said flap cover when said flap cover is folded to close the container, said flap blocking a portion of a container opening;

wherein a width of said container opening as measured from the front panel to the rear panel and a length of the flap panel creates a tension such that said locking members tend to pull rearward from said hook members causing a locking action when engaged therewith; and said hook members positioned rearwardly of said front panel with an upper free portion of each hook member extending toward the front of the container.

8. The container of claim 7 wherein the bottom is flat.

9. The container of claim 7 wherein the material is paper-based, foam or plastic.

10. The container of claim 7 further comprising a first pre-fold between the flap and the front panel and a second pre-fold between the flap cover and the rear panel.

11. A food container form comprising:

a single piece of flat material having:

a front and rear panel section joined by a bottom section, said front and rear panels sections including outer portions which are foldable into container sides;

a flap cover section extending from said front panel section, said flap cover section including a pair of outwardly, oppositely directed locking members;

a flap section and a pair of cut-out sections on opposite sides thereof wherein said cut-out sections are configured to secure said locking members of a container constructed from the form such that said flap section is positioned beneath said flap cover section when the constructed container is closed; and wherein in a container constructed from said form, said cut-out sections forming hook members and said hook members positioned rearwardly of said front panel with an upper free portion of each hook member extending toward the front of the container.

12. The food container form of claim 11 wherein each of said cut-out sections define a hook member for securing said locking members when the constructed container is closed.

13. The food container form of claim 11 wherein the single piece of material is paper-based, foam or plastic.

* * * * *